US006199559B1

(12) United States Patent
Nikolaus et al.

(10) Patent No.: US 6,199,559 B1
(45) Date of Patent: Mar. 13, 2001

(54) HERMETICALLY SEALED COSMETIC COMPACT CASE

(75) Inventors: Carol J. Nikolaus, Shorewood; Lawrence G. Davis, Menomonee Falls, both of WI (US); James Rudolph Rowland, III, Kittrell, NC (US); James J. Thalheimer, Toms River, NJ (US); Keith S. Everson, Hartford; Michael G. Katz, Whitefish Bay, both of WI (US)

(73) Assignee: Rexam Cosmetic Packaging, Inc., Sussex, WI (US)

( * ) Notice: Subject to any disclaimer, the term of this patent is extended or adjusted under 35 U.S.C. 154(b) by 0 days.

(21) Appl. No.: 09/472,573

(22) Filed: Dec. 27, 1999

(51) Int. Cl.[7] ..... A45D 33/24; A45D 33/26

(52) U.S. Cl. ..... 132/294; 132/295; 132/293; 206/581

(58) Field of Search ..... 132/293, 294, 132/295, 296, 298, 301; 206/314, 45.24, 317, 581, 823; 220/783, 326, 4.21

(56) References Cited

U.S. PATENT DOCUMENTS

| | | | | |
|---|---|---|---|---|
| 1,290,671 | | 1/1919 | Sherwood . | |
| 2,094,696 | | 10/1937 | Botelho | 132/83 |
| 2,362,120 | | 11/1944 | Swart | 220/55 |
| 2,418,578 | | 4/1947 | Crane | 220/60 |
| 3,442,414 | | 5/1969 | Pelli | 220/31 |
| 3,788,027 | | 1/1974 | Figari | 53/24 |
| 3,810,090 | | 5/1974 | Davis, Jr. et al. | 340/58 |
| 3,919,549 | | 11/1975 | Sahores et al. | 250/310 |
| 4,018,237 | | 4/1977 | Steiman | 132/83 R |
| 4,254,775 | | 3/1981 | Langer | 128/419 D |
| 4,347,943 | | 9/1982 | Hackwell et al. | 220/306 |
| 4,454,889 | * | 6/1984 | Contreras, Sr. | 132/294 |
| 4,466,196 | | 8/1984 | Woodruff | 33/288 |
| 4,471,880 | | 9/1984 | Taylor et al. | 220/306 |
| 4,586,519 | | 5/1986 | Seidler et al. | 132/83 R |
| 4,756,140 | * | 7/1988 | Gannon | 53/434 |
| 4,781,288 | * | 11/1988 | Wing | 206/581 |
| 4,917,131 | | 4/1990 | Contreras, Sr. | 132/301 |
| 5,078,159 | | 1/1992 | Yuhara | 132/295 |
| 5,107,871 | | 4/1992 | Butcher et al. | 132/304 |
| 5,135,012 | | 8/1992 | Kamen et al. | 132/294 |
| 5,323,794 | | 6/1994 | Favre | 132/294 |
| 5,353,818 | * | 10/1994 | Suzuki et al. | 132/294 |
| 5,431,177 | | 7/1995 | Kecman | 132/303 |
| 5,515,875 | | 5/1996 | Acker et al. | 132/298 |
| 5,520,202 | | 5/1996 | Arbee | 132/294 |
| 5,582,314 | | 12/1996 | Quinn et al. | 220/326 |
| 5,590,024 | | 12/1996 | Honda et al. | 361/684 |
| 5,638,838 | | 6/1997 | Lombardi | 132/294 |
| 5,646,820 | | 7/1997 | Honda et al. | 361/683 |
| 5,842,486 | * | 12/1998 | Davis et al. | 132/295 |
| 5,875,918 | | 3/1999 | Sheffler et al. | 220/783 |
| 6,135,277 | * | 10/2000 | Armstrong | 206/314 |

FOREIGN PATENT DOCUMENTS

| | | |
|---|---|---|
| 380299 | 9/1964 | (CH) . |
| 0 919 156 | 6/1999 | (EP) . |
| 2576496 | 8/1986 | (FR) . |
| 599452 | 3/1948 | (GB) . |
| WO 83/02051 | 6/1983 | (WO) . |
| WO 98/36985 | 8/1998 | (WO) . |

* cited by examiner

*Primary Examiner*—Pedro Philogene
(74) *Attorney, Agent, or Firm*—Foley & Lardner

(57) ABSTRACT

A container for storing makeup is disclosed. The container includes a cover having a first interface, the first interface having a first periphery. The container also includes a base for holding a cosmetic substance, the base having a second interface, the second interface having a second periphery corresponding to the first periphery. The container also includes a generally hermetic seal providing a channel associated with the first interface and a peripheral rim associated with the second interface. The container includes a discharge for reducing the air pressure integral with the first or the second interface. The first interface and the second interface provide a substantially hermetic seal when the cover is closed with respect to the base.

25 Claims, 7 Drawing Sheets

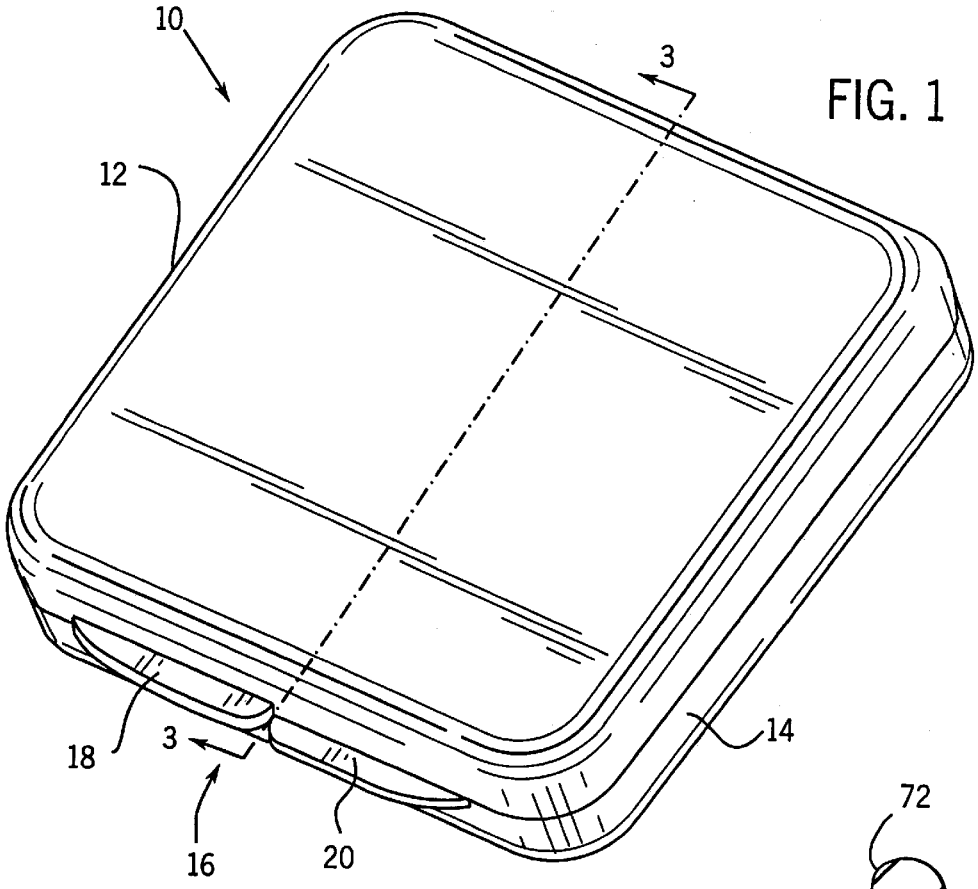
FIG. 1
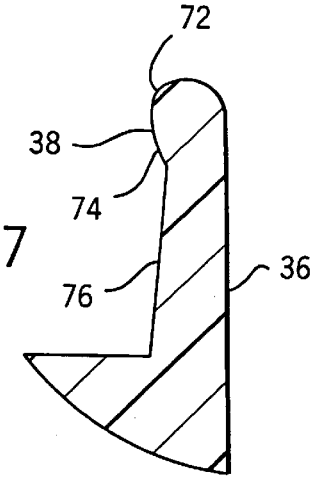
FIG. 7
FIG. 8
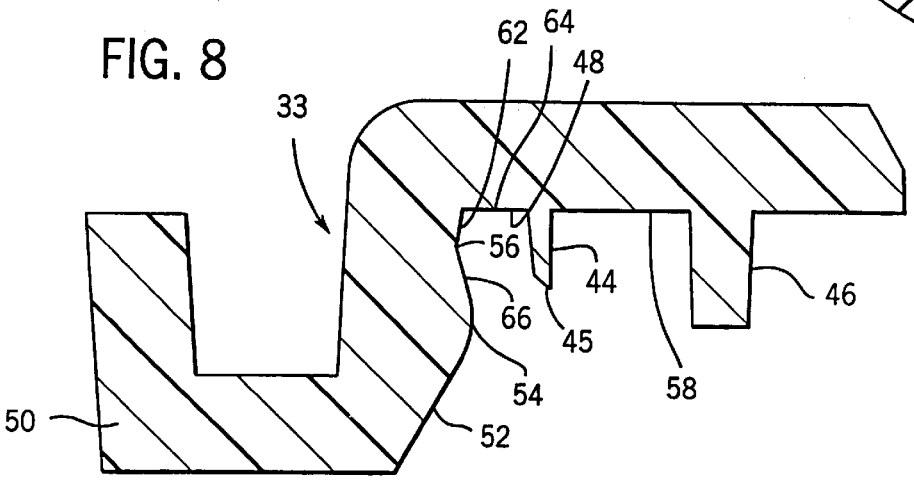

HERMETICALLY SEALED COSMETIC COMPACT CASE

CROSS REFERENCE TO RELATED APPLICATIONS

The following U.S. patents are cited by reference and are hereby incorporated by reference: U.S. Pat. No. 5,842,486 titled "HERMETICALLY SEALED COSMETIC COMPACT CASE" assigned to an assignee of the present invention.

FIELD OF THE INVENTION

The present invention relates to a make-up case or a cosmetic compact. More particularly, the present invention relates to an airtight or hermetically sealed cosmetic compact case.

BACKGROUND OF THE INVENTION

Conventional compact cases hold makeup or cosmetics, such as, powders, eye shadow, eyeliner, lipstick, or other beauty aids. Compacts often provide a mirror for viewing the face, thereby facilitating the process of applying the makeup to the face.

A compact usually includes a lid or a cover section hingeably coupled to a base or a container section. Either the cover section or the base section can be pivoted about the hinge to obtain the closed configuration of the compact, thereby providing a convenient storage device. The mirror is typically disposed on the inside of the compact cover section. The base section of conventional compacts usually includes a metal pan for containing the makeup. Alternatively, the makeup can be directly stored in a cavity in the base section.

Compacts also allow for a pad, a brush, or other application device to be disposed between the base and the cover, when the compact is in the closed configuration. Makeup is usually applied by rubbing or dipping the application device (e.g., the pad or brush) in the pan or cavity holding the makeup. The application device is then used to transfer the makeup to the face.

A popular type of cosmetic currently available in most retail stores is a Color-Stay™ or colorfast makeup or cosmetic. The popularity of these cosmetics apparently stems from the ability of the makeup to remain applied to the skin surface for a prolonged period without rubbing off or fading. Colorfast cosmetics contain a somewhat volatile chemical component that requires airtight or hermetic storage to prevent or inhibit drying, hardening, and cracking of the cosmetics. In particular, the colorfast cosmetic must be stored in a hermetically sealed container. Therefore, colorfast cosmetic containers often must undergo and pass a loss-in-weight test to establish that an airtight seal has been effected.

Conventional compacts are usually arranged as a one-piece unit so that one hand opens and holds the compact, while the other hand applies the makeup to the skin surface of the face. In contrast, conventional colorfast cosmetic cases include a container with a screw-on cap that effects a hermetic seal when in the closed configuration. Thus, the user must contend with two separate pieces, which makes applying the makeup a more difficult task, i.e., it is more difficult for the user to unscrew the cap and apply the makeup at the same time.

To apply the color-fast cosmetic from its cosmetic case, the user must unscrew the cap and place it somewhere so that one hand can hold the container that stores the makeup, while the other hand is free to apply the makeup to the skin surface of the face with greater dexterity. In having to lay the screw-on cap somewhere during the process of applying the colorfast makeup, the potential exists for the cap to be misplaced or lost, especially in a crowded public restroom during a social function. Without the screw-on cap to hermetically seal the unused portion remaining in the container, the colorfast makeup dries, hardens, and its quality deteriorates. As a result, the user must incur an additional expense by purchasing new makeup.

Another problem with current colorfast cosmetic cases occurs when the user is not aware that the screw-on cap is not properly closed, e.g., sealed, on the container. If the hermetic seal is not established as a result of incomplete or improper closure of the colorfast cosmetic case, the makeup dries, hardens, and cracks.

Other colorfast makeup cases use a complex method of opening and closing. These cases require that the user follow unconventional directions to appropriately open and close the makeup case. Thus, these cases often require additional steps to open and close the case that can annoy the user.

Another problem with known makeup cases is that product placed within the pan decreases the volume available for air in the pan. In makeup cases having a hermetic seal, excess air pressure may be entrapped in the pan when the case is closed. Such excess air pressure may cause a break in the hermetic seal, thereby allowing atmospheric air to corrupt the integrity of the product.

Thus, there is a need for an inexpensive and simple-to-use compact case capable of effecting an airtight or hermetic seal. Further, there is a need for an airtight, hermetically sealed compact case that passes the loss-in-weight test. Further still, there is a need for a hermetically sealed compact case that can be manufactured as a one-piece unit and can be simply opened and closed. Even further still, there is the need for an airtight compact case that generates an audible indication whenever the hermetic seal is established. It would also be advantageous to provide a makeup case configured to reduce air pressure within the generally sealed pan.

SUMMARY OF THE INVENTION

The present invention relates to a container for storing makeup. The container includes a cover having a first interface, the first interface having a first periphery. The container also includes a base for holding a cosmetic substance, the base having a second interface, the second interface having a second periphery corresponding to the first periphery. The container also includes a generally hermetic seal providing a channel associated with the first interface and a peripheral rim associated with the second interface. The container includes a discharge for reducing the air pressure integral with the first or the second interface. The first interface and the second interface provide a substantially hermetic seal when the cover is closed with respect to the base.

The present invention further relates to a container body for storing makeup. The container body is configured for selective movement between a first position and a second position. The container includes a base coupled to a cover by a hinge. The container further includes a rim having a shape extending from the cover. The container further includes a channel integral with and disposed between a first wall and a second wall of the base and having a shape corresponding to the shape of the peripheral rim. The container further includes at least one vent for reducing the air pressure in the container coupled to the seal. When the container is in the first position the rim is received by the channel such that air is discharged to the exterior of the container and provides a generally hermetic seal between the base and the cover.

The present invention further relates to a makeup case for holding a cosmetic substance. The case provides a cavity contained by a cover and a base. The case is selectively positionable between a first position and a second position. The case is configured to provide a generally hermetic seal between the cover and the base when the cover is in the first position, whereby the seal maintains the cover in the first position. The case further includes a vent for regulating the air pressure inside the cavity. When the cover is positioned from the second position to the first position air is discharged from the cavity to the atmosphere.

The present invention further relates to a method of using a makeup container. The method includes providing a makeup container selectively positionable between a first position and a second position and having a base coupled to a cover by a hinge and including a cavity for holding a cosmetic substance. The method also includes placing the container in the first position. The method also includes placing the cosmetic substance in the cavity. The method also includes moving the container from the first position at least partially to the second position. The method also includes discharging air from the cavity to the atmosphere. The method also includes moving the container to the second position to provide a generally hermetic seal between the cover and the base.

The present invention further relates to a container for holding items. The container includes a cavity configured to receive the items. The container also includes a generally hermetic seal for substantially partitioning the cavity from the environment selectively repositionable between a first position and a second position. The container also includes a vent for regulating the air pressure inside the cavity. Air is discharged from the cavity to the atmosphere when the seal is positioned from the first position to the second position and the cavity is substantially impervious to air from the atmosphere when the seal is in the second position.

BRIEF DESCRIPTION OF THE DRAWINGS

Exemplary embodiments of the present invention will hereinafter be described wherein like numerals denote like elements, and:

FIG. 1 is a perspective view of a cosmetic compact case in accordance with an exemplary embodiment of the present invention, the case is shown in a closed configuration;

FIG. 7 is an enlarged, partial cross-sectional view of a lip illustrated in FIG. 4; and FIG. 8 is an enlarged, partial cross-sectional view of a channel illustrated in FIG. 4;

DETAILED DESCRIPTION OF THE PREFERRED EMBODIMENTS

Figure 2:
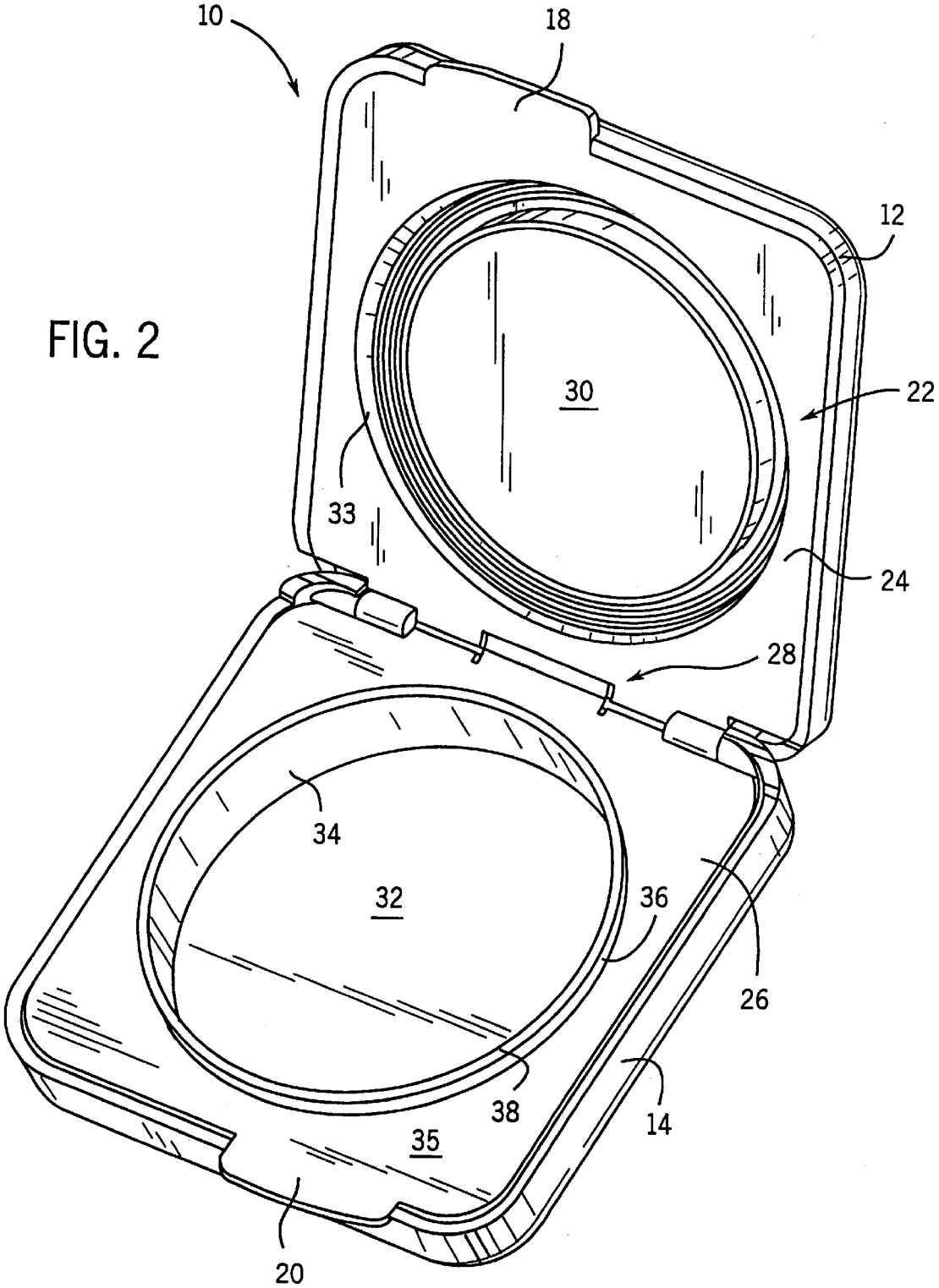
FIG. 2 is a perspective view of the cosmetic compact case illustrated in FIG. 1 in an opened configuration, demonstrating an integral two-piece insert contained therein.
Figure 3:
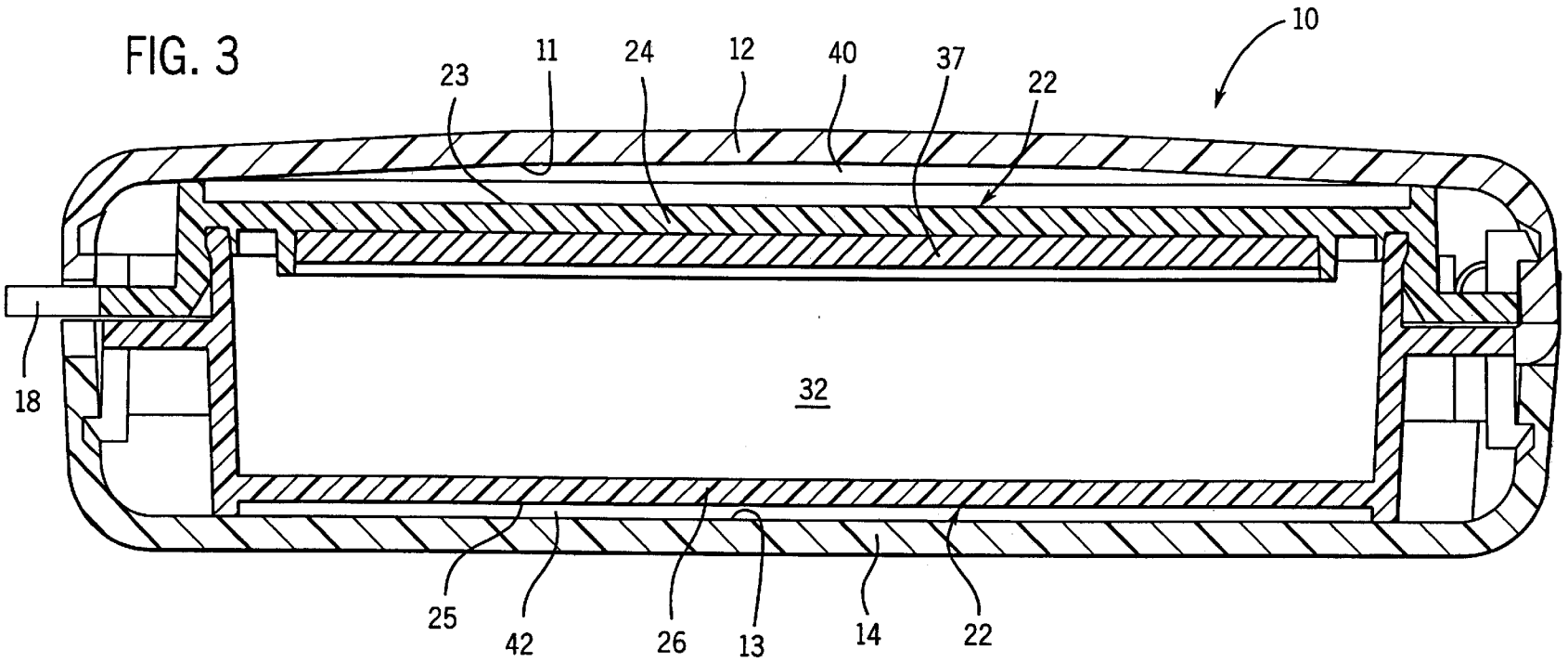
FIG. 3 is a cross-sectional view of the closed cosmetic compact case illustrated in FIG. 1, taken along line 3—3.

With reference to FIGS. 1, 2, and 3, a makeup case or compact 10 is shown. Compact 10 is a cosmetic case for holding a cosmetic substance, such as, powder, eye shadow, eyeliner, or other beauty aid. In particular, compact 10 is preferably a cosmetic case for containing a colorfast, e.g., a non-fading and rub-resistant, makeup with an airtight seal.

FIG. 1 is a perspective view showing compact 10 in a closed configuration. Compact 10 includes an exterior shell which is comprised of a top or cover section 12 hingeably coupled (see FIG. 2) to a bottom or a base section 14. Compact 10 also includes an opening interface 16. Interface 16 includes a top member 18 and a bottom member 20. Interface 16 facilitates opening of compact 10 when top member 18 engages bottom member 20. Alternatively, interface 16 can include a pivoting member similar to conventional shoe polish canisters.

As an external downward force is applied, such as, by hand, to cover section 12 to effect pivotal motion in a direction toward base section 14, compact 10 achieves a closed configuration. As section 12 approaches section 14 and achieves the closed configuration, the traditional snapping sound associated with the closing of a conventional compact is emitted. Interface 16 can also be configured to perform a latching operation for compact 10. Although compact 10 is shown in a quadrangular shape, other geometries, such as, oval, circular, hexagonal, and so forth, can also be used.

With reference to FIG. 2, compact 10 is shown in an opened configuration. Compact 10 further includes an integral two-piece insert 22. Insert 22 preferably includes a top or cover piece 24 integral with a bottom or base piece 26. More specifically, cover piece 24 of insert 22 is pivotally coupled to base piece 26 via a living hinge 28. Insert 22 is shaped in accordance with compact 10 and is sized to fit within the combination of sections 12 and 14. Insert 22 is preferably made of a polypropylene plastic.

Figure 4:
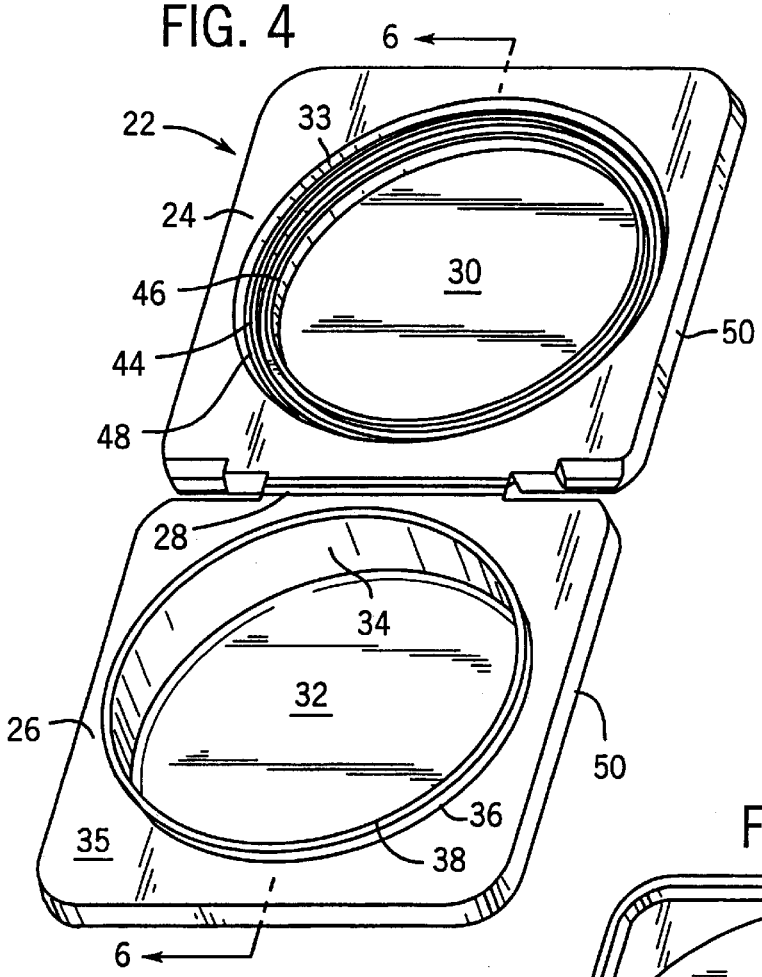
FIG. 4 is a top perspective view of the integral two-piece insert illustrated in FIG. 2.

Cover piece 24 of insert 22 includes a circular cavity 30 having a periphery (see FIG. 4). In one preferred embodiment, a mirror can be disposed within circular cavity 30 for viewing the face when applying the makeup. Similarly, base piece 26 has a circular cavity 32 defined by a peripheral wall 34. A peripheral rim 36 is integral with (e.g., continuous) with peripheral wall 34, circumferentially extends above a surface 35 of base piece 26, and melds into a terminal, outwardly protruding lip 38. Circular cavity 32 is preferably configured to hold the colorfast makeup. Alternatively, instead of circular cavity 32, base piece 26 can include an aperture configured such that a pan pre-filled with makeup can be disposed therein.

FIG. 3 is a cross-sectional view of compact 10 in a closed configuration, taken along line 3—3 of FIG. 1. Circular cavity 30 within piece 24 is shown with a mirror 37 disposed therein. Circular cavity 32 is shown in an empty state. Compact 10 also includes interface gaps 40 and 42. Interface gap 40 is disposed between an internal surface 11 of cover 12 and an exterior surface 23 of cover piece 24 of insert 22. Interface gap 42 is disposed between an internal surface 13 of base section 14 and an external surface 25 of base piece 26 of insert 22. Interface gaps 40 and 42 are configured to be large enough to allow expansion of cover piece 24 and base piece 26, respectively, of insert 22 during loss-in-weight tests.

Figure 5:
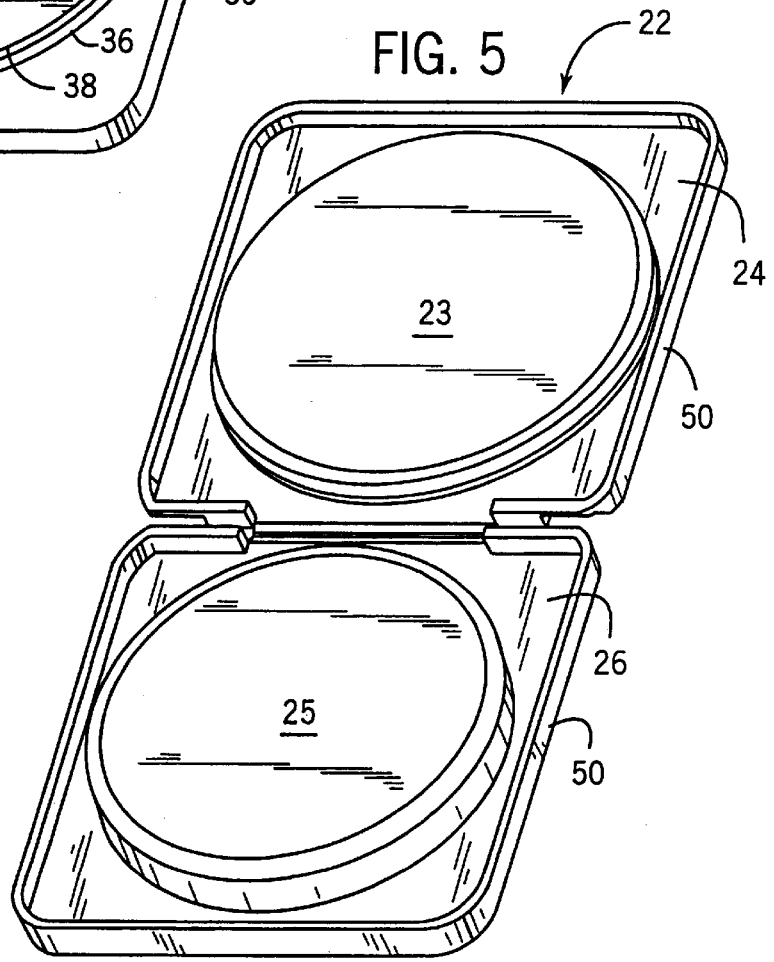
FIG. 5 is a bottom perspective view of the integral two-piece insert illustrated in FIG. 4.

FIGS. 4 and 5 show insert 22 in a fully extended, opened configuration. In particular, FIG. 4 is a top perspective view of insert 22, whereas FIG. 5 is a bottom perspective view. A groove 48 is circumferentially defined between a peripheral edge 33 of cavity 30 and shorter peripheral wall 44. Groove 48 is configured to receive peripheral rim 36 when insert 22 is in a closed configuration (e.g., when cover piece 24 engages base piece 26), thereby effecting a hermetic, i.e., airtight, seal. Insert 22 does not have, nor needs, a clasp or fastener to sustain a closed configuration: the hermetic seal maintains insert 22 in a closed state.

As shown in the bottom perspective view of insert 22 (FIG. 5), the perimeter of cover piece 24 and base piece 26 is defined by a continuous peripheral rim 50 that overhangs in the direction toward external surfaces 23 and 25, respectively. Rim 50 can be used to secure or snap insert 22 within sections 12 and 14. Rim 50 is preferably configured to span a height of 0.16 inch.

In one preferred embodiment, when in the fully extended configuration, insert 22 spans a length of 6 inches, having a respective 3-inch length for both cover piece 24 and base piece 26. Alternatively, insert 22 can have other dimensions complementary to fit any sized compact 10.

Figure 6:
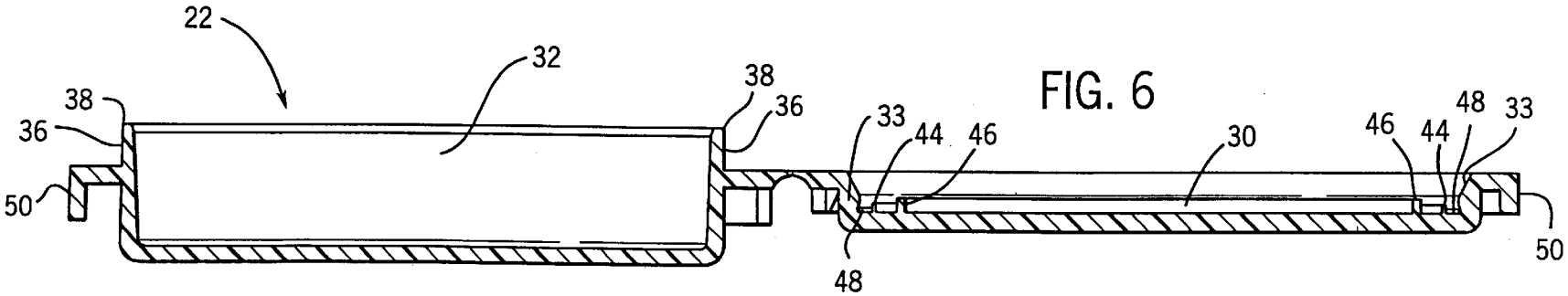
FIG. 6 is a cross-sectional view of the insert illustrated in FIG. 4 about line 6—6.

With reference to FIG. 6, a cross-sectional view of insert 22 in the fully extended configuration is shown, taken about line 6—6 of FIG. 4. Living hinge 28 is shown fully extended and circular cavity 30 and circular cavity 32 both appear in an empty state. Lip 38 is shown protruding outwardly from peripheral rim 36. With reference to cover piece 24, groove 48 appears between shorter peripheral wall 44 and peripheral edge 33.

Both FIGS. 7 and 8 are enlarged, partial cross-sectional views of different aspects of insert 22. More specifically, FIG. 7 shows an enlarged, partial cross-sectional view of lip 38 extending from peripheral rim 36. FIG. 8 is an enlarged, partial cross-sectional view showing groove 48 disposed between peripheral wall 44 and peripheral edge 33. FIG. 8 further shows that peripheral wall 44 terminates in a free end 45 and spans a height that is shorter than a height of peripheral wall 46. Wall 46 can serve to hold a mirror in cavity 30.

As shown in FIG. 8, peripheral edge 33 includes a chamfer edge 52, a bulge 54 protruding in a direction toward groove 48, and an indentation 56 pointed in a direction away from wall 44. A groove 58 is disposed between shorter peripheral wall 44 and peripheral wall 46.

In one preferred embodiment, the nominal thickness of peripheral wall 34 (FIG. 4) is 0.06 inches. The height of peripheral rim 36 (FIG. 7), including lip 38, is preferably 0.172 inches, with a width of 0.032 inches (without lip 38). Lip 38 preferably has a width of 0.043 inches and a height of 0.027 inches. Lip 38 has a radius of 0.025 inches at an end 72. A surface 74 is provided at a 20° angle with respect to a surface 76.

Peripheral wall 44 (as shown in FIG. 8) preferably has a height of 0.045 inches and a thickness of 0.016 inches. Wall 46 preferably has a height of 0.07 inches and a thickness of 0.04 inches. A free end 45 of wall 44 is slanted at a 45° angle with respect to a vertical axis. The surface of wall 44 bordering groove 48 is slightly slanted at an 8° angle with respect to the vertical axis. A wall 62 associated with indent 56 is provided at a 10° angle from the vertical axis.

Bulge 54 of peripheral edge 33 is curved with a radius of 0.025 inches. Groove 48 has a width of 0.040 inches and wall 62 has a height of 0.024 inches. Bulge 54 is at a distance of 0.060 inches from a surface 64 of groove 48 and terminates at a distance of 0.080 inches from surface 64. A wall 66 has a height of 0.036 inches and is provided at a 15° angle from the vertical axis.

Alternatively, other dimensions can be used. The given dimensions are exemplary only and do not limit the scope of the claims.

The closing and opening of insert 22 is discussed as follows. To close insert 22, an external downward force is supplied, such as, by hand, to cover piece 24 to effect a pivotal motion of cover piece 24 toward base piece 26. More specifically, as a result of the applied downward force on cover piece 24, hinge 28 folds to close cover piece 24 onto base piece 26.

In the process of closing insert 22, groove 48 receives peripheral rim 36 between first peripheral wall 44 and peripheral edge 33 (as shown in FIGS. 4, 6, and 8), thereby effecting a hermetic, i.e., air-tight, seal at the interface. The seal can be formed between peripheral wall 34 and peripheral wall 44 or rim 36 and edge 33. Moreover, bulge 54 of peripheral edge 33 pushes peripheral rim 36 to bias peripheral wall 34 towards peripheral wall 44. Even further, lip 38 of peripheral rim 36 fits into indentation 56 of peripheral edge 33, thus securing the hermetic seal and maintaining insert 22 in the closed configuration. Compact 10 does not require a latch to maintain insert 22 in the closed configuration. As insert 22 obtains the closed configuration, the evacuated air makes a distinctive audible sound, indicating that the hermetic seal has been established. The seal associated with compact 10 is somewhat similar to seals utilized in photographic film containers or plastic food storage containers.

To open insert 22, a pulling force is applied, such as, by hand, to cover piece 24 in a direction away from base piece 26. In the process of separating or disengaging cover piece 24 from base piece 26 from the closed configuration of insert 22, peripheral rim 36 is removed from within groove 48, thereby disrupting, e.g., breaking, the hermetic seal formed at the interface between peripheral wall 34 and peripheral wall 44. As cover piece 24 is disengaged from base piece 26, another audible sound is emitted, indicating the hermetic seal has been broken. As hinge 28 unfolds, cover piece 24 is further pivotally moved in a direction away from base piece 26. The terms airtight and hermetic, as used in this application, refer to an essentially non-leaking seal formed at atmospheric pressure. The airtight seal can preferably pass a loss-in-weight test when the case contains colorfast makeup.

Figure 9:
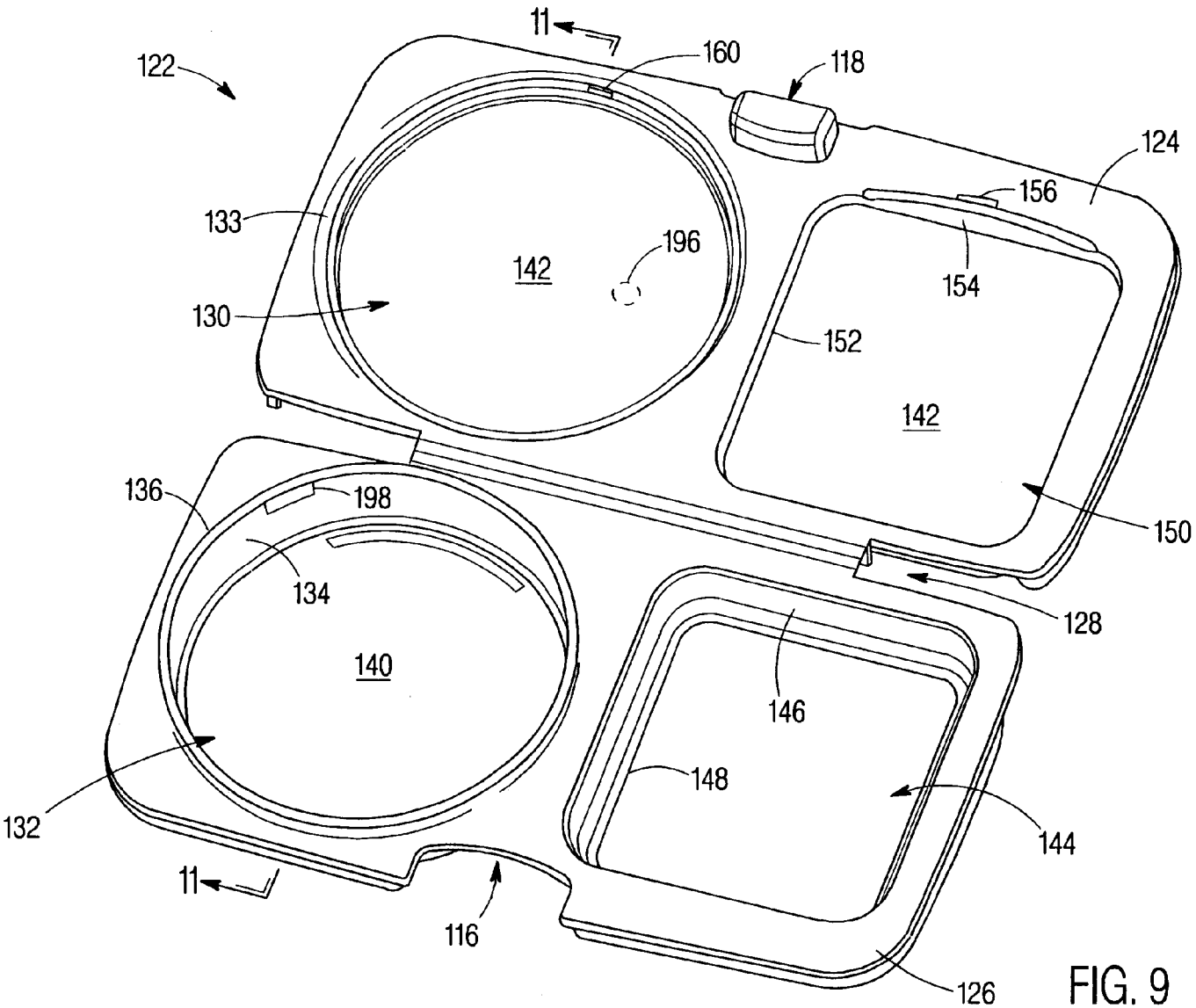
FIG. 9 is a perspective view of an insert of a compact case in an opened configuration according to an alternative embodiment.

Referring to FIG. 9, an insert 122 (similar to insert 22) is shown according to an alternative embodiment. Insert 122 includes a cover 124 connected to a base 126 by a living hinge 128. Insert 122 is selectively movable between an opened configuration (as shown in FIG. 9) and a closed configuration (e.g., as shown in FIG. 1). According to an alternative embodiment, the insert can be placed in an external shell or housing providing an articulating lever. An integral member (shown as a detent 118) protrudes from cover 124. Detent 118 is configured to clear a recessed finger 116 in base 126 and to coact with the lever (not shown). Detent 118 coacts with the lever to assist in opening insert 122 from the closed configuration.

Insert 122 includes a generally circular cavity 132 for holding items (not shown) such as a cosmetic products, makeup, a pan for holding cosmetics, etc., which may be placed in cavity 132 and supported by a base plate 140. A wall 134 providing a rim 136 extends from base plate 140. The shape of cavity 132 corresponds to the shape of cavity 130. Cavity 130 includes a generally circular cover plate 142 circumscribed by a peripheral edge 133 defining a groove (shown as a channel 131 in FIG. 11). When insert 122 is in the closed configuration, rim 136 is received by channel 131 to provide the generally hermetic seal. The generally or substantially hermetic seal is strong enough to inhibit the spoiling, degradation, loss in weight, etc. of the items, which may be stored in cavity 132, due to the entry of atmospheric gas, air or other atmospheric conditions (e.g., water, debris, etc.) into cavity 132.

Insert 122 also includes a generally square shaped aperture 144 for holding an accessory (not shown) such as a mirror, pan, fabric, makeup puff, application device, etc., and surrounded by a wall 146. A flange 148 extends from wall 146 such that the accessory may be placed in aperture 144 and may be supported by flange 148. A cavity 150 in cover 124 corresponds to the shape of aperture 144 and is defined by a wall 152. A flange 154 of wall 152, which includes a detent 156, extends from cover plate 142. Detent 156 is configured to coact with a recessed finger (not shown) in wall 146 and may assist in securing cover 124 to base 126 when insert 122 is in the closed configuration.

Figure 10:
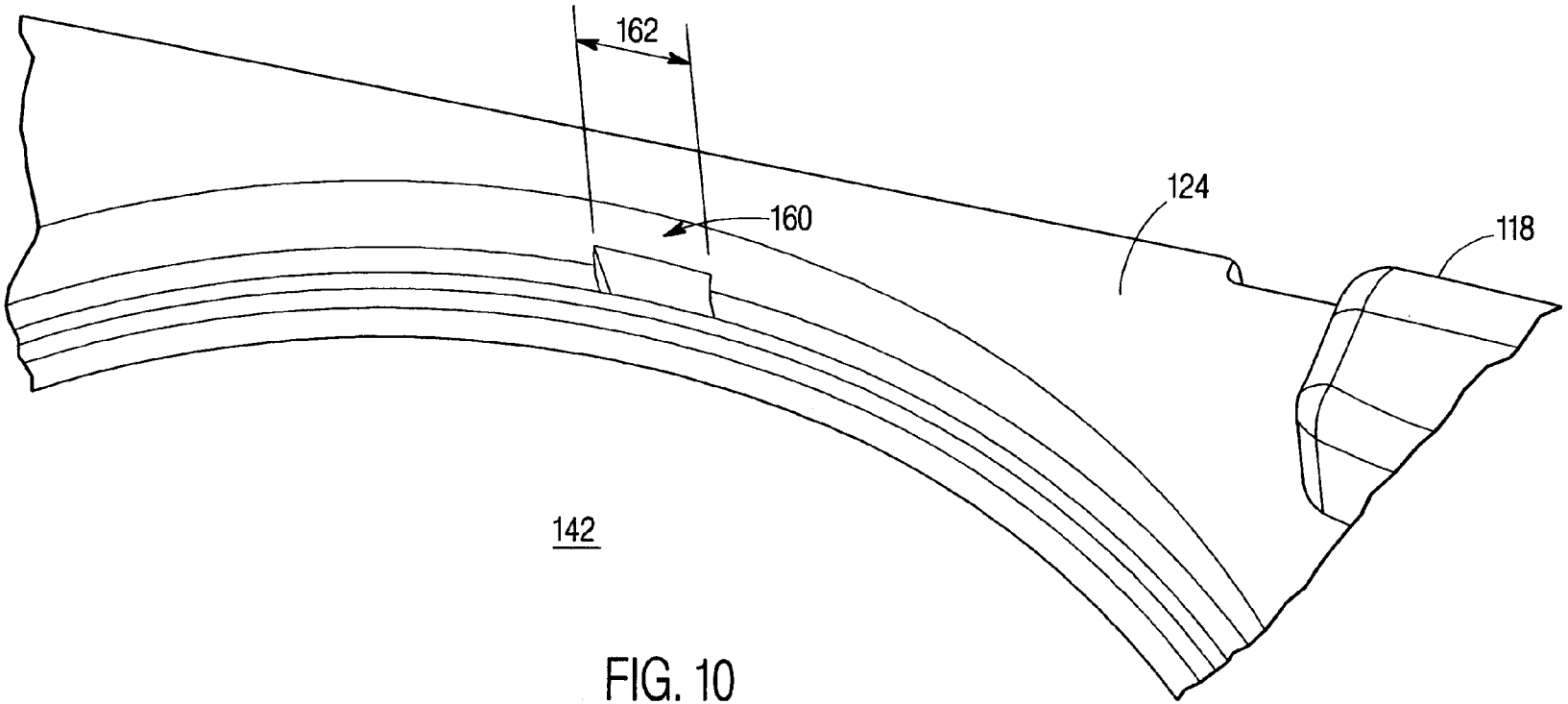
FIG. 10 is a fragmentary perspective view of a vent disposed in the insert of FIG. 9.
Figure 11:
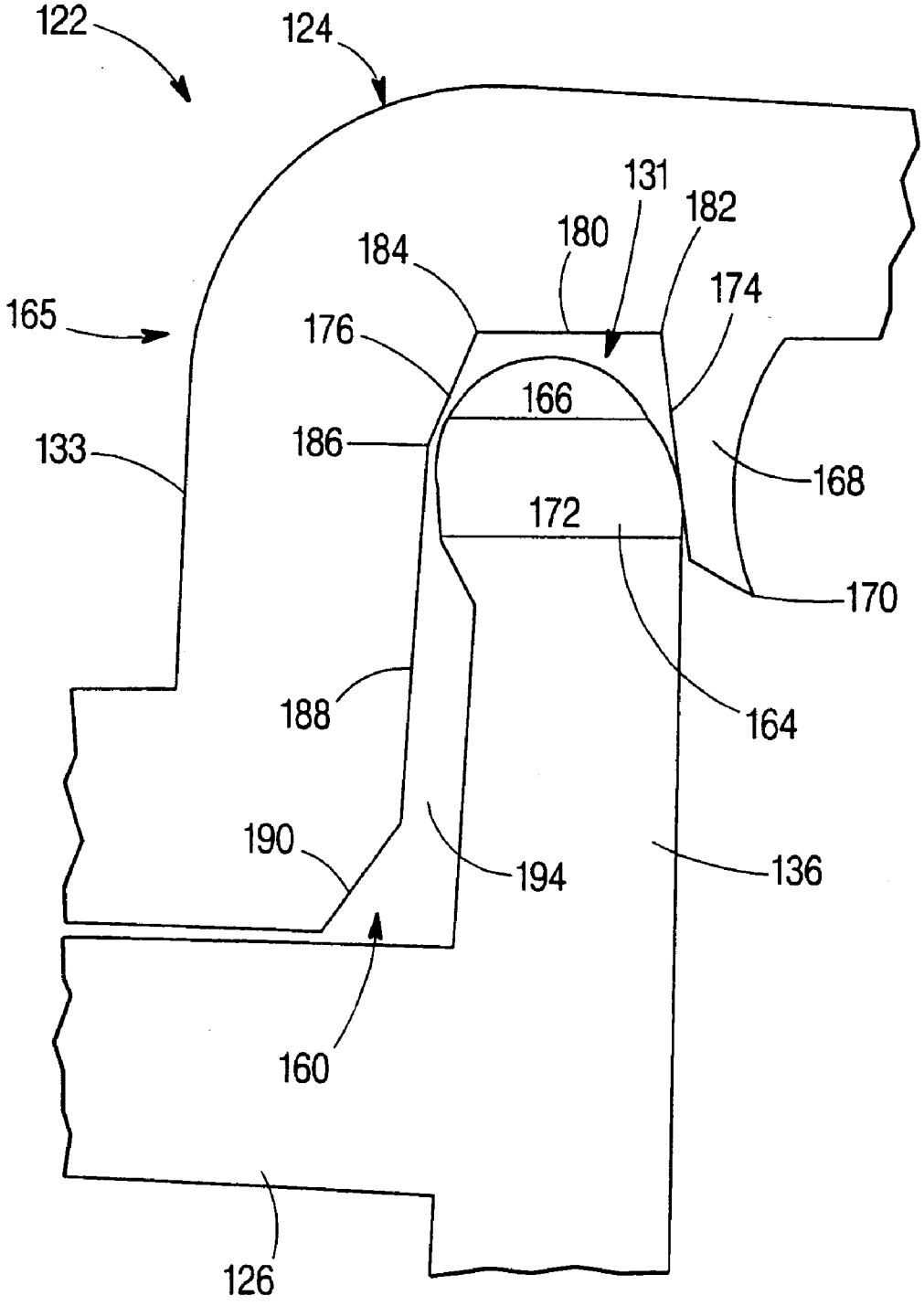
FIG. 11 is a fragmentary cross sectional view of the insert of FIG. 9 in a closed configuration taken along line 11—11 of FIG. 9.

Referring to FIG. 10, a discharge (shown as a vent 160) for discharging or venting air from cavities 130 and 132 is shown. Vent 160 may be generally square shaped and has a width 162. Vent 160 is recessed in and integral with peripheral edge 133 (adjacent channel 131). Referring to FIG. 11, insert 122 is shown in a fully closed configuration 165, which provides a generally hermetic seal between base 126 and cover 124, such that the space defined by cavities 130 and 132 is generally impervious to atmospheric air. A generally blunt or circular head 164 of rim 136 is shown inserted within channel 131 of cover 124. Channel 131 is disposed between a wall (similar to wall 44 and shown as a wiper 168) providing a terminal or free end 170 and peripheral edge 133 of cover 124. Channel 131 is defined by sealing surfaces or inclined walls 174 and 176, and a potential sealing surface 180 of cover plate 142. Peripheral edge 133 includes a flattened bulge 188 of vent 160 extending from inclined wall 176 and substantially parallel to rim 136. A chamfer edge 190 extends from flattened bulge 188. Inclined wall 174 and surface 180 intersect at an obtuse angle 182, and inclined wall 176 and surface 180 intersect at an obtuse angle 184. Inclined wall 176 and bulge 188 intersect at an obtuse angle 186. (An obtuse angle is an angle of greater than about 90 degrees.) Channel 131 has a minimum width 172, and head 164 has a maximum width 166. The maximum width 166 of head 164 may be greater than the minimum width 166 of channel 131 such that wiper 168 deforms slightly when head 164 is inserted into channel 131.

In operation of insert 122, vent 160 provides for the discharge or venting of air from cavities 130 and 132 to the atmosphere. To discharge air from cavities 130 and 132, insert 122 is positioned from the opened configuration to fully closed configuration 165 (i.e., "closing" the insert). Such closing of insert 122 permits air trapped within cavities 130 and 132 to be discharged to the atmosphere. As insert 122 is closed, head 164 may be inserted within channel 131. Excess air may be discharged from cavities 130 and 132, along inclined wall 174 of wiper 168 and out of channel 131 along a slot 194 associated with flattened bulge 188 and chamfer edge 190. Such excess air is discharged to the atmosphere until insert 122 is in fully closed configuration 165, in which cover 124 is in an abutting relationship to base 126. Such discharge of air from cavities 130 and 132 is accomplished for the period from when head 164 enters channel 131 until head 164 is in a facing relationship with surface 180 and substantially abuts against inclined wall 176. Without intending to be limited by theory, it is believed that the vent permits enough space between the head and the cover to permit air to be discharged from the cavities during the closing of the insert and to the last moment before the insert is positioned in the closed configuration. The vent functions to permit gas or air to be discharged (i.e., escape) from the cavity during closing of the insert, but does not substantially degrade the generally hermetic seal when the insert is in the closed position. Thus, the contents (e.g., makeup) in the cavity are not substantially degraded even though the insert includes a vent.

A generally hermetic seal is formed between head 164 and channel 131 when insert 122 is in the closed configuration. Without intending to be limited by theory, it is believed that the hermetic seal may be formed at the following interfaces: between head 164 and inclined wall 174; between head 164 and surface 180 of cover plate 142; between head 164 and inclined wall 176; between head 164 and bulge 188; and/or any combination thereof. As a result of the interference and hermetic seal formed between rim 136 and cover 124, substantially no atmospheric air is drawn within cavities 130 and 132. The interference of head 164 with inclined walls 174, 176 and/or 188 may assist in retaining insert 122 in the closed configuration.

Referring further to FIG. 11, the quality of the interference or seal between bulge 188 and head 164 is generally less than the hermetic seal formed by insert 22 (see FIGS. 7–8), because of the substantially eliminated contact between bulge 188 and head 164. Thus, air from cavities 130 and 132 is permitted to escape through slot 194 during the closing of insert 122. Without intending to be limited by theory, it is believed that air is discharged from cavities 130 and 132 until head 164 of insert 122 is in contact with inclined wall 176 (as shown in FIG. 11) or until head 164 of insert 122 is in contact with surface 180 (as shown in FIG. 11).

According to a particularly preferred embodiment, the insert is constructed of polypropylene. The cosmetic product is poured into a pan and the pan is glued into the cavity. The wiper is flexible such that it may be slightly deformed when the head is inserted in the channel. The width of the vent is about 0.125 inches, the depth of the channel is about 0.039 inches, the width of the channel is about 0.038 inches, and the width of the head is about 0.044 inches. The length of the inclined wall of the wiper is about 0.037 inches, the length of the surface of the cover plate is about 0.036 inches, the length of the inclined wall extending from the surface of the cover plate is about 0.018 inches, and the length of the inclined wall extending from the flattened bulge is about 0.023 inches. The obtuse angle between the inclined wall of the wiper and the surface of the cover plate is about 95 degrees, the obtuse angle between the inclined wall of the peripheral edge and the surface of the cover plate is about 115 degrees, the obtuse angle between the inclined wall and the flattened bulge is about 145 degrees, and the obtuse angle between the flattened bulge and the chamfer edge is about 150 degrees. The cavities of the insert contain a volume of about 20–21 cubic centimeters in volume The foregoing description has been presented for purposes of explanation and illustration only, and is neither exhaustive nor restrictive. Although only a few exemplary embodiments have been described, the present invention is not limited to one particular embodiment. Indeed, to practice the invention in a given context, those skilled in the art may conceive of variants to the embodiments described herein without materially departing from the true spirit and scope of the invention. For example, variations may be made in sizes, structures, shapes and proportions of the various elements, values of parameters, mounting arrangements, or use of materials. The insert may be placed within a housing, the exterior of which may include decorative or functional surface treatments. The hinge may be any type of hinged member (e.g., plate hinge, pin hinge, living hinge, etc.). The rim and the channel may be textured or lubricated to vary the amount of resistance or interference between the rim and the channel. The vent may include a mechanism to monitor and/or signal when the pressure in the cavities is too high, and may also include a check valve 196 to increase or decrease the pressure in the cavities in response to such signal. The cover plate or the base plate of the insert may be provided with baffles, or may be flexible such that they can withstand a significant increase or decrease of pressure in the cavities. A flexible rib 198 may be provided across the rim such that the rib is deflected to permit air to be vented from the cavities. The base plate may be deformed (e.g., by pushing the center of the base plate towards the cover and lifting an end of the base plate) to reduce the volume within the cavities, thereby evacuating air from the cavities in a "burping" fashion before closing the insert.

It is understood that the above description is of preferred exemplary embodiments of the present invention. The invention is not limited to the precise details and conditions disclosed. For example, the shape of the described compact is quadrangular. However, other geometries, such as, circular, oval, hexagonal, and so forth, can also be used. Although specific dimensions are recited for aspects of the integral two-piece insert, other dimensions can be used complementary to fit any sized compact. Various modifications may be made to the details of the disclosure without departing from the spirit of the invention, which is defined in the appended claims. When interpreted in accordance with the breadth to which they are fairly, legally, and equitably entitled, the appended claims and their equivalents embrace all such modifications, variations, substitutions, and omissions.

What is claimed is:

1. A container for storing makeup, the container comprising:

a cover having a first interface, the first interface having a first periphery;

a base for holding a cosmetic substance, the base having a second interface, the second interface having a second periphery corresponding to the first periphery;

a generally hermetic seal providing a channel associated with the first interface and a peripheral rim associated with the second interface; and a discharge for reducing the air pressure integral with the first or the second interface;

wherein the first interface and the second interface provide a substantially hermetic seal when the cover is closed with respect to the base and air is discharged from the container when the first interface engages the second interface.

2. The container of claim 1, wherein the channel is defined by a peripheral wall and the peripheral edge of the peripheral rim being received between the first periphery and the peripheral wall.

3. The container of claim 2, wherein the first periphery includes a bulge.

4. The container of claim 3, wherein the first periphery and the second periphery are circular shaped.

5. The container of claim 1, further comprising a housing coupled to the cover and the base, wherein the housing includes a cavity, the cavity allowing expansion of the cover or the base.

6. The container of claim 5, wherein the cavity is sized to permit expansion during loss-in-weight tests.

7. The container of claim 6, wherein the cover and the base are integral and joined by a hinge.

8. A container body for storing makeup configured for selective movement between a first position and a second position, the container comprising:

a base coupled to a cover by a hinge;

a rim having a shape extending from the cover;

a channel integral with and disposed between a first wall and a second wall of the base and having a shape corresponding to the shape of the peripheral rim; and at least one vent for reducing the air pressure in the container coupled to the seal;

wherein, when the container is in the first position the rim is received by the channel such that air is discharged to the exterior of the container and provides a generally hermetic seal between the base and the cover.

9. The container body of claim 8, wherein the rim is generally circular shaped.

10. The container body of claim 9, wherein the rim further includes a first sealing portion, a second sealing portion and a third sealing portion, and the channel further includes a first wall, a second wall and a third wall and at least one sealing portion is in direct contact with at least one wall to form the hermetic seal.

11. The container body of claim 10, wherein the vent is a generally square shaped recess in the channel.

12. The container body of claim 10, wherein the vent is a check valve.

13. The container body of claim 10, wherein the vent is a baffle provided in the cover configured for selective movement between a first and a second position in response to pressure exerted on the baffle.

14. The container body of claim 11, further comprising a generally circular shaped cavity configured to receive the makeup.

15. The container of claim 14, where the channel further includes an opening having a diameter less than the diameter of the rim.

16. The container body of claim 15, further comprising a housing for receiving the body and the cover.

17. The container body of claim 16, further comprising a second generally circular shaped rim extending from the cover configured to receive a mirror.

18. The container body of claim 17, wherein at least two sealing portions are in direct contact with at least two walls to form the hermetic seal.

19. The container body of claim 18, wherein the rim is integral with the cover.

20. The container body of claim 19, wherein the height of the rim is less than about 0.1 inches, the width of the rim is less than about 0.1 inches and the width of the vent is less than about 0.2 inches.

21. A makeup case for holding a cosmetic substance, the case providing a cavity contained by a cover and a base, the cover being selectively positionable between a first position and a second position, and configured to provide a generally hermetic seal between the cover and the base when the cover is in the first position, whereby the seal maintains the cover in the first position, the improvement comprising:

a vent for regulating the air pressure inside the cavity;

wherein when the cover is positioned from the second position to the first position air is discharged from the cavity to the atmosphere.

22. The improvement of claim 21, wherein the vent is a generally square shaped recess in the seal.

23. A method of using a makeup container, comprising:

providing a makeup container selectively positionable between a first position and a second position and having a base coupled to a cover by a hinge and including a cavity for holding a cosmetic substance comprising;

placing the container in the first position;

placing the cosmetic substance in the cavity;

moving the container from the first position at least partially to the second position;

discharging air from the cavity to the atmosphere; and moving the container to the second position to provide a generally hermetic seal between the cover and the base.

24. The method of using a makeup container as recited in claim 23, further comprising compressing the center of the cover, lifting the edge of the base to evacuate air from the cavity and securing the base to the cover.

25. A container for holding items, comprising:

a cavity configured to receive the items;

a generally hermetic seal for substantially partitioning the cavity from the environment selectively repositionable between a first position and a second position; and a vent for regulating the air pressure inside the cavity;

wherein air is discharged from the cavity to the atmosphere when the seal is positioned from the second position to the first position and the cavity is substantially impervious to air from the atmosphere when the seal is in the second position.

* * * * *

UNITED STATES PATENT AND TRADEMARK OFFICE

CERTIFICATE OF CORRECTION

PATENT NO. : 6,199,559 B1
DATED : March 13, 2001
INVENTOR(S) : Nikolaus et al.

It is certified that error appears in the above-identified patent and that said Letters Patent is hereby corrected as shown below:

Title page,
Item [73], Assignees should include the following:

-- (1) Rexam Cosmetic Packaging, Inc., Sussex, WI (US); and (2) Revlon Consumer Products Corporation, New York, NY (US). --

Signed and Sealed this

Ninth Day of July, 2002

*Attest:*

*Attesting Officer*

JAMES E. ROGAN
*Director of the United States Patent and Trademark Office*